US011053103B2

(12) United States Patent
Strandberg et al.

(10) Patent No.: US 11,053,103 B2
(45) Date of Patent: Jul. 6, 2021

(54) LIFTING ASSEMBLY FOR A WIND TURBINE

(71) Applicant: S&L Access Systems AB, Västerås (SE)

(72) Inventors: Michael Strandberg, Stockholm (SE); Kenneth Lundberg, Västerås (SE)

(73) Assignee: S&L Access Systems AB, Västerås (SE)

( * ) Notice: Subject to any disclaimer, the term of this patent is extended or adjusted under 35 U.S.C. 154(b) by 0 days.

(21) Appl. No.: 16/583,405

(22) Filed: Sep. 26, 2019

(65) Prior Publication Data

US 2020/0102193 A1 Apr. 2, 2020

(30) Foreign Application Priority Data

Oct. 2, 2018 (EP) ..... 18198258

(51) Int. Cl.

| | |
|---|---|
| ***B66C 23/18*** | (2006.01) |
| ***B66C 23/20*** | (2006.01) |
| ***B66C 23/30*** | (2006.01) |
| ***B66C 23/42*** | (2006.01) |
| *B66C 23/68* | (2006.01) |
| *B66C 23/72* | (2006.01) |

(52) U.S. Cl.

CPC ..... *B66C 23/185* (2013.01); *B66C 23/207* (2013.01); *B66C 23/30* (2013.01); *B66C 23/42* (2013.01); *B66C 23/68* (2013.01); *B66C 23/72* (2013.01)

(58) Field of Classification Search

CPC ..... B66C 23/185; B66C 23/207; B66C 23/30; B66C 23/42; B66C 23/68; B66C 23/72; B66C 23/283

See application file for complete search history.

(56) References Cited

U.S. PATENT DOCUMENTS

| | | | | |
|---|---|---|---|---|
| 9,266,701 | B2 | 2/2016 | Bosco et al. | |
| 2014/0202971 | A1* | 7/2014 | Bosco | B66C 23/185 212/296 |
| 2015/0167342 | A1* | 6/2015 | Montaner Fraguet | B66C 23/30 52/745.18 |
| 2017/0008740 | A1* | 1/2017 | Hess | B66C 23/283 |
| 2017/0334685 | A1 | 11/2017 | Kersten et al. | |

FOREIGN PATENT DOCUMENTS

| | | | |
|---|---|---|---|
| CN | 107416703 | A | 12/2017 |
| EP | 2 746 571 | A2 | 6/2014 |
| EP | 3 230 195 | A1 | 10/2017 |

* cited by examiner

*Primary Examiner* — Jun S Yoo

(74) *Attorney, Agent, or Firm* — Dilworth & Barrese, LLP

(57) ABSTRACT

The present invention relates to a lifting assembly (1) for elevating components to a wind turbine (5). The lifting assembly comprises a plurality of tower segments (13) which together form an elongated tower (9), a support frame (11) for supporting the tower (9), a securing assembly (32) securing the tower (9) to the wind turbine (5). The lifting assembly (1) further comprises an upper platform (7) provided with and a crane (21) and vertically movable along the tower (9), and a lower platform (8) provided with a storage area (16) for supporting components and vertically movable along the tower (9) between the upper platform (7) and the support frame (11). The crane is adapted to move components to and from the storage area (16) of the lower platform (8).

17 Claims, 8 Drawing Sheets

LIFTING ASSEMBLY FOR A WIND TURBINE

TECHNICAL FIELD

The present invention relates to a lifting assembly for elevating components to the top of a wind turbine. The invention also relates to a method for using the lifting assembly for transportation of components to and from the top of a wind turbine during maintenance of the wind turbine.

BACKGROUND

Wind turbines today require regular maintenance of its main components, such as rotor blades, gear boxes and generators. However, these components are often large and heavy, which poses an issue during both the assembly and the maintenance of the wind turbines. For example, the gear boxes may weigh between 20-45 tons, and the generators may weigh between 15-30 tons. Today, the most common solution is to use large, heavy cranes that lift the components from the ground with long wires. One of the problems with these cranes is that they are highly sensitive to wind and cannot operate while the wind velocity exceeds certain limits, since the crane becomes too unstable and the wire might start to swing. This can result in stoppage of production for long periods of time, decreasing the profitability of the wind turbines. Additionally, the large size and weight of the cranes most commonly used today cause problems with transportation and assembly of the cranes. A large number of vehicles is required today to transport the different parts of the cranes, and once the transportation is completed, the assembly of these parts takes a very long time to finish. All the problems mentioned above cause the assembly and the maintenance of the wind turbines to become expensive and time-consuming.

U.S. Pat. No. 9,266,701 B2 discloses an enhanced stability crane, including a telescoping main support mast upon which a crane base resides. A boom projects upwardly from the crane base and a jib typically projects upwardly from the boom. The crane is adapted to have a load capacity of at least 160,000 pounds and a maximum jib height of at least 262 feet. This invention addresses the issue of stability by using a clamping assembly which resides on the main support mast and is configured to attach to an existing structure adjacent to the crane. This clamping assembly enhances the stability of the mast. The size and weight of the enhanced stability crane is also reduced in comparison to the cranes most commonly used today. However, a problem with this invention is that it does not account for the instability of the crane's wire, meaning it is still sensitive to high winds. Another disadvantage is that the crane residing on the main support mast is large and heavy, increasing the overall size and weight of the invention.

Accordingly, there is a need for a lifting assembly for lifting and positioning the main components of wind turbines, which are smaller in size, less heavy and more resistant to wind.

SUMMARY

It is an aim of the present invention to at least partly overcome the above problems, and to provide an improved lifting assembly for wind turbines.

This aim is achieved by a lifting assembly as defined herein.

The lifting assembly comprises a plurality of tower segments which together form an elongated tower, a support frame for supporting the tower, a securing assembly securing the tower to the wind turbine, a crane, an upper platform vertically movable along the tower, and a lower platform vertically movable along the tower between the upper platform and the support frame, wherein the crane is disposed on the upper platform and the lower platform is provided with a storage area for supporting components, and the crane is adapted to move components to and from said storage area of the lower platform.

The upper platform is arranged movable along the tower between a lower and an upper position relative the support frame. The upper platform is used to transport the crane along the tower and to position the crane at a suitable vertical position relative the wind turbine. Having the crane mounted on the vertically movable upper platform allows the crane to be moved in a vertical direction along the wind turbine. The lower platform is arranged below the upper platform. Since the lower platform is vertically movable between the upper platform and the support frame and is provided with a storage area for supporting components, the lower platform can transport components between ground and the upper platform. The crane is capable to move the components between the storage area of the lower platform and the wind turbine. Due to the fact that the crane is transported by the upper platform and the components are transported by the lower platform, the weight of each of the platforms can be reduced. Further, the power needed to transport the components is reduced compared to if the crane and the component were transported on the same platform.

The components are placed on the storage area of the lower platform and moved between ground and the upper platform by means of the lower platform. The upper platform and accordingly the crane are located at a desired vertical location relative the wind turbine. The crane is adapted to move the components between the lower platform and the wind turbine when the lower platform is close to the upper platform. The crane can pick up the component from the storage area and move it to the wind turbine and vice versa. This is a far more stable way for transporting a component up to the top of a wind turbine than by e.g. using a large crane having long wires that can cause the component to start swinging. In the present invention, the lifting of the component onto the storage area is done in the lower position and the lifting of the component onto the wind turbine is done in the upper position. This allows for the lifting distance to be minuscule compared to the conventional methods where the component is lifted directly from the ground onto the top of the wind turbine.

The storage area is preferably designed for supporting components weighing more than 10 tons to allow the storage area to support heavy component of the wind turbine, such as the gear box, the generator and the turbine blades. This means that the storage area is designed to have the mechanical strength needed to support components weighing more than 10 tons. Preferably, the storage area is designed for supporting components weighing more than 20 tons, and most preferably more than 30 tons since the size and weight of the components varies depending on the size of the wind turbine.

According to an aspect, the area of the storage area is at least 4 $m^2$. Thus, the storage area provides enough space for supporting the components.

Having the crane mounted on the upper platform allows the crane to be moved in a vertical direction along the wind turbine. The crane is adapted to move the components between the lower platform and the wind turbine when the lower platform is in close vicinity to the upper platform. Preferably, the crane is adapted to enable lifting of components weighing more than 10 tons. Preferably, the weight of the crane is more than 10 tons. A crane lighter than 10 tons might not be able to lift necessary objects, e.g. the components of the wind turbine and segments of the tower.

According to one aspect, each of the upper and lower platforms is provided with an opening adapted to receive the tower. The openings are aligned in a vertical direction so that the tower can extend through the openings and accordingly through the platforms. With the term "aligned in a vertical direction" is meant that they are arranged above each other with respect to the vertical line. Thus, the tower is allowed to penetrate through both openings at the same time. The openings in the platforms allow the platforms to have a stable and easy connection to the tower. Further, the opening allows the platform to protrude a distance at different horizontal directions from the tower. This provides for a plurality of spaces for housing heavy objects at opposite positions relative the tower such that the weights of the objects will balance each other during transportation of the platforms along the tower. This is particularly important when the platform is being moved upward or downward along the tower, since an unbalanced platform will cause wear of the drive mechanism moving the platform. This is also beneficial due to the fact that a balanced platform will not cause as much strain on the tower. Thus, the tower segments will wear less.

Since the openings are adapted to receive the tower, the openings and the tower segments preferably have a corresponding shape. According to an aspect, the openings and the peripheries of the tower are rectangular. A rectangular tower is easier and accordingly cheaper to manufacture.

According to one aspect, the upper platform comprises a second opening aligned in a vertical direction with the storage area to allow a component to be moved to and from the storage area through the second opening of the upper platform. The second opening makes it easier to move components between the upper and lower platforms. Further, the second opening facilities for the crane to move components between the storage area and the wind turbine.

According to an aspect, the lower platform comprises a base frame, and a support member having an upper surface defining said storage area, and the support member is arranged movable in a vertical direction relative the base frame. The movable support member makes it possible to move the storage area to the second opening of the upper platform, and by that facilitates transportation of components, such as a tower segments, between the upper and lower platforms.

According to an aspect, the lower platform comprises a lifting mechanism adapted to move the support member in a vertical direction relative the base frame. Thus, the storage area can be raised and lowered in relation to the second opening of the upper platform.

According to an aspect, the upper platform comprises a transportation unit adapted to move a tower segment between the second opening and the first opening. This makes it possible to automatically move tower segments between the first and second openings of the upper platform during building and dismantling of the tower. Thus, lifting assembly can be used for building and dismantling the tower, as well as for transportation of components to and from the wind turbine.

According to an aspect, the transportation unit comprises at least two transportation unit rails adapted to engage with a first engaging portion attachable to the tower segments, and a propulsion mechanism adapted to move tower segments from the second opening to the first opening by means of the transportation unit rails.

According to an aspect, the lower platform comprises a lower platform drive unit for the vertical movement of the lower platform and a lower platform power supply unit adapted to provide the lower platform drive unit with power, and the lower platform power supply unit and the storage area are arranged on opposite sides of the first opening of the lower platform. By arranging the power supply unit in this manner, its weight helps to compensate for the weight of the components being supported on the first storage area, meaning the platform will become more balanced in weight. This is particularly important when the platform is being moved along the tower since an unbalanced platform will cause wear on the drive unit.

According to an aspect, the tower segments comprise gear racks, the upper platform comprises an upper platform drive unit for the vertical movement of the upper platform, and at least one upper platform gear wheel driven by the upper platform drive unit and adapted to engage with the gear racks on the tower segments, and the lower platform comprises a lower platform drive unit for the vertical movement of the lower platform, and at least one lower gear wheel driven by the lower platform drive unit and adapted to engage with the gear racks on the tower segments.

According to an aspect, the securing assembly is attached to the upper platform. Thus, the upper platform and the tower are secured to the wind turbine.

According to an aspect, the securing assembly comprises two arms horizontally movable relative to each other and bent towards each other to allow them to clamp around the wind turbine. Thus, it is possible for the arms to clamp around the wind turbine and by that fixedly connect the tower and the upper platform to the wind turbine. The term "clamp around the wind turbine" is to be interpreted in a broad manner and covers that the arms are partly, as well as fully, surrounding the wind turbine.

According to an aspect, said arms are pivotally attached to the upper platform.

According to an aspect, the storage area is arranged on an upper part of the lower platform and a space for transportation of passenger is defined below the storage area.

Thus, the lower platform can be used for transportation of people, as well as components, at the same time.

According to an aspect, the support frame comprises a transfer unit adapted to move the tower in a horizontal direction relative the support frame. Thus, the horizontal distance between the tower and the wind turbine can be adjusted. Further, the horizontal distance between the upper and lower platforms, and the wind turbine can be adjusted.

According to an aspect, the support frame comprises at least two support frame rails adapted to engage with a second engaging portion attached to the tower, and the support frame comprises a propulsion mechanism adapted to linearly move the tower by means of the support frame rails.

The length of the tower depends on the height of the wind turbine. Preferably, the elongated tower is higher than 60 m, more preferably higher than 80 m, and most preferably higher than 100 m. However, if necessary the tower can be more than 120 m. The tower segments are adapted to be arranged on top of each other to form the tower. By means of arranging the tower segments on top of each other the tower's height can be modified, and the tower is also easy to dismantle, thus facilitating the transport of the tower. The number of tower segments can be varied in dependence on the height of the wind turbine and the length of the tower segments. Since a plurality of tower segments makes up the tower, each tower segment can be made at such a low height that the vehicles delivering the tower segment can do so without requiring any extra transporting measure as e.g. using an escort. The length of the tower segments may vary. In order to facilitate transportation of the tower segments, the length of the tower segments may vary between 2-10 m. However, it also possible to have tower segments with a length up to 24 m.

BRIEF DESCRIPTION OF THE DRAWINGS

The invention will now be explained more closely by the description of different embodiments of the invention and with reference to the appended figures.

DETAILED DESCRIPTION

Figure 1:
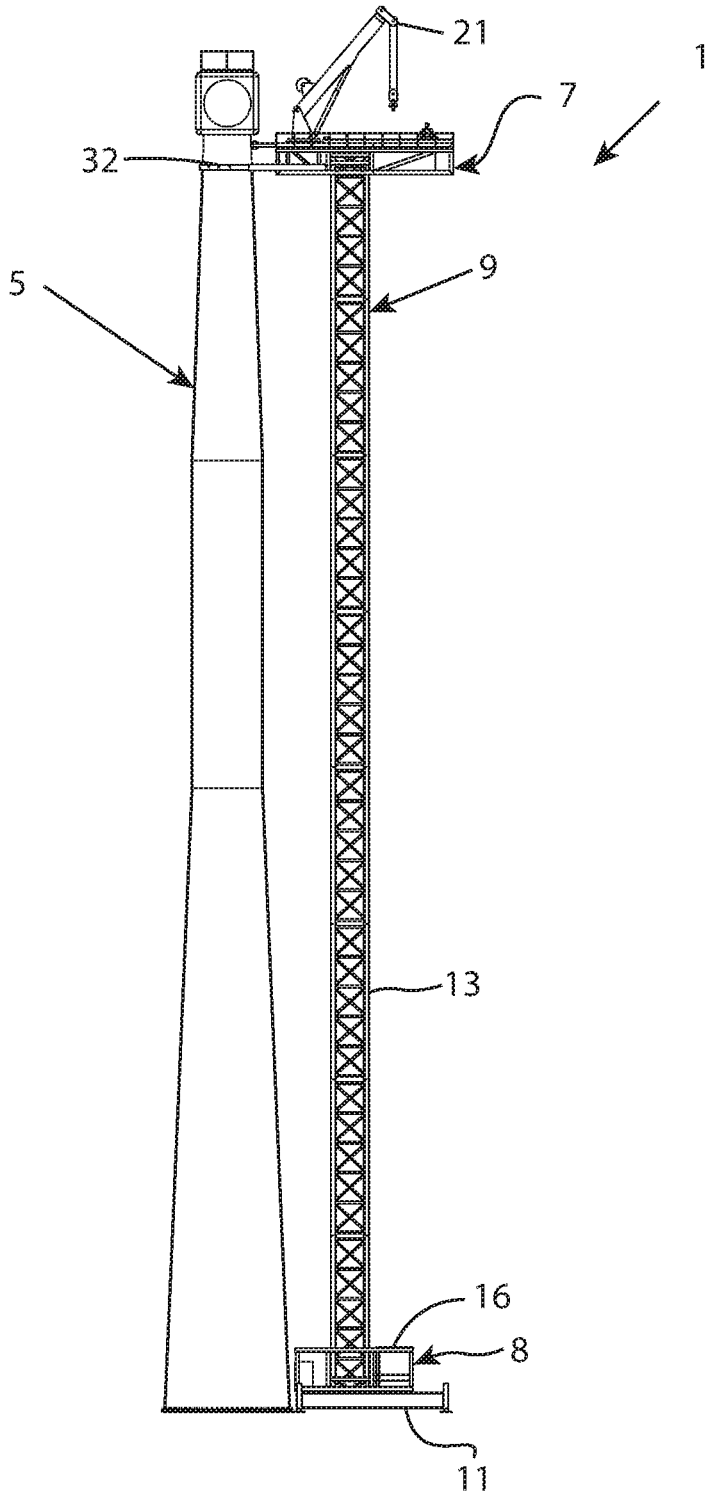
FIG. 1 shows an example of a lifting assembly seen in a side view.

FIG. 1 shows a lifting assembly 1 seen in a side view. The lifting assembly 1 is adapted to elevate components 3 to a wind turbine 5. The lifting assembly 1 comprises a plurality of tower segments 13 stacked upon each other forming an elongated tower 9. When the tower is assembled, its longitudinal axis is aligned with the vertical line and accordingly with the wind turbine. The tower segments are adapted to be fixedly attached to each other by means of e.g. nuts. The lifting assembly 1 further comprises a support frame 11 adapted to support the tower 9 and a securing assembly 32 for securing the tower 9 to the wind turbine 5. The lifting assembly 1 also comprises an upper platform 7 provided with a crane 21. The upper platform 7 is arranged movable along an axis parallel to a longitudinal axis of the tower, and accordingly the upper platform in movable in a vertical direction. The upper platform 7 is arranged vertically movable relative the tower 9 between a lower position and an upper position. The upper position relates to the highest position the upper platform 7 can currently reach on the tower 9. The upper position is mutable depending on the number of tower segments 13 forming the tower 9. The lower position relates to the lowest position the upper platform 7 can reach on the tower 9. The lifting assembly 1 further comprises a lower platform 8. The lower platform 8 is arranged below the upper platform 7 and is arranged vertically movable between the upper platform 7 and the support frame 11. The lower platform 8 is arranged movable along an axis parallel to the longitudinal axis of the tower, and accordingly the lower platform in movable in a vertical direction. The lower platform 8 has a storage area 16 adapted to support components 3. The components 3 can be, for example, any wind turbine component e.g. a gear box or it could be a tower segment 13. The crane 21 is adapted to move the components between the storage area 16 of the lower platform 8 and the wind turbine 5.

The storage area 16 is preferably designed for supporting components weighing more than 10 tons to allow the storage area to support heavy component of the wind turbine, such as the gear box, the generator and the turbine blades. This means that the storage area is designed to have the mechanical strength needed to support components weighing more than 10 tons. More preferably, the storage area is designed for supporting components weighing more than 20 tons, and most preferably more than 30 tons since the size and weight of the components varies depending on the size of the wind turbine. According to an aspect, the area of the storage area is at least 4 $m^2$. Thus, the storage area provides enough space for supporting the components.

Figure 6A:
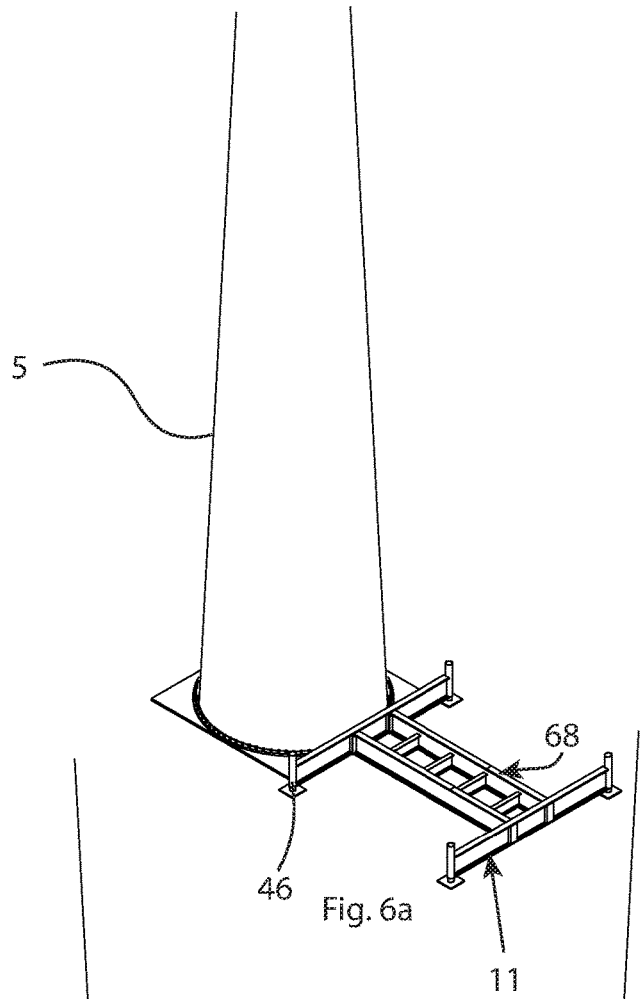
FIGS. 6*a-c* illustrate an example of the assembly of a tower base.
Figure 6B:
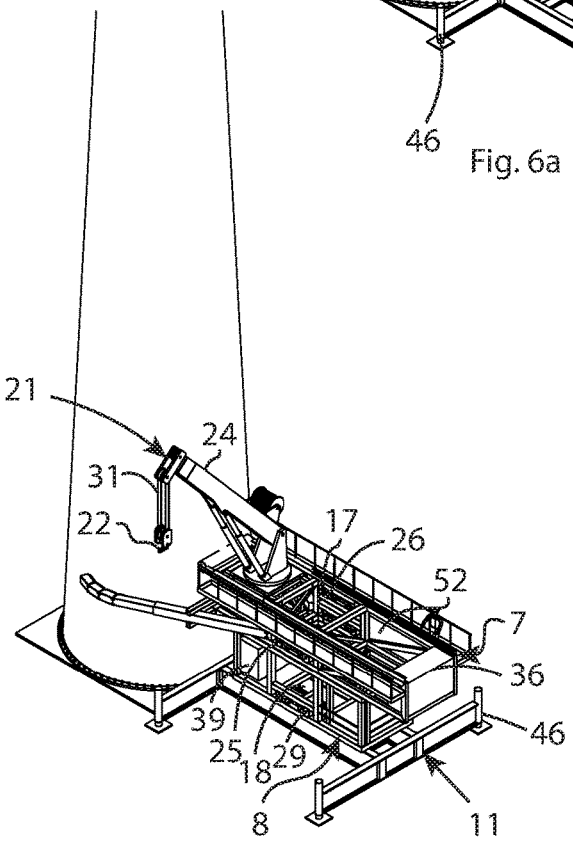

The upper and lower platforms 7, 8 are provided with openings 17, 18, respectively, adapted to receive the tower 9, as for example shown in FIG. 6*b*. The openings 17 and 18 are arranged vertically aligned and the tower penetrates through the openings 17, 18. The openings 17, 18 are aligned along the longitudinal axis of the tower. Accordingly, the openings are vertically aligned to allow the tower to extend through the openings 17, 18. The opening 17 on the upper platform 7 is hereinafter referred to as the first opening 17. In this example, the crane 21 is arranged in closer proximity to the wind turbine 5 than the storage area 16 which is also arranged on a different side of the tower 9 relative to the crane 21.

Figure 2:
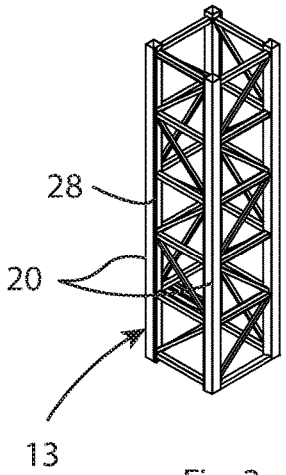
FIG. 2 shows an example of a tower segment seen in a perspective view.

FIG. 2 shows an example of a tower segment 13. In this example, the tower segment 13 comprises a framework including a plurality of joists. The joists are connected to four elongated beams 20 extending parallel to each other and are arranged on each corner of the tower segment 13. The tower segments 13 further comprise two or more gear racks 28 attached to at least two beams 20. Suitably, the gear racks 28 are arranged so that they extend the full length of the beam 20 in a longitudinal direction. The gear racks 28 are also protruding at a distance perpendicular to the longitudinal direction of the beam. In this example, each beam 20 has one gear rack 28 so that each tower segment 13 has a total of four gear racks 28. However, it is also possible to have more or less number of gear racks. The gear racks 28 are attached to an outer portion of the beams 20 and are arranged so that every gear rack 28 faces another gear rack 28.

Figure 3:
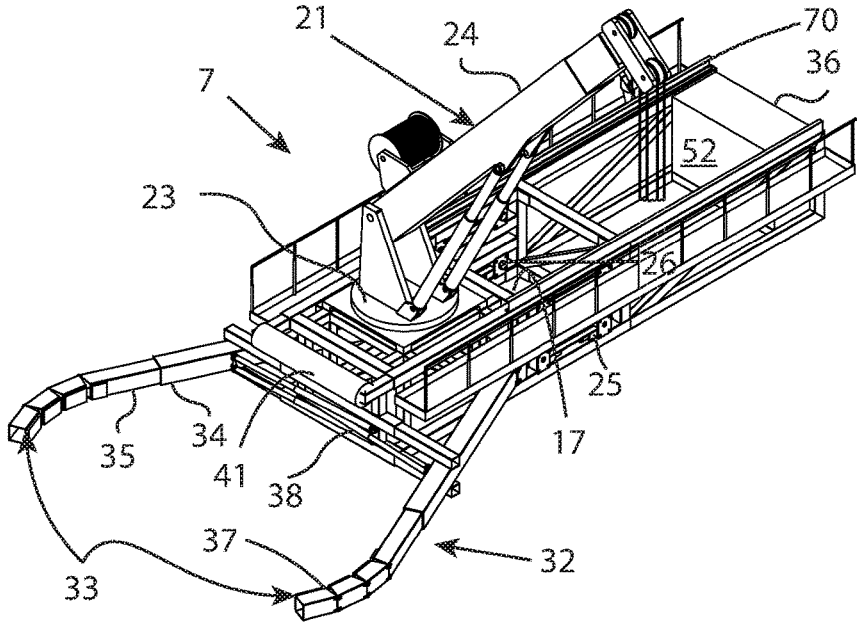
FIG. 3 shows an example of an upper platform and a securing assembly seen in a perspective view from above.

FIG. 3 shows an example of the upper platform 7. In this example, the upper platform 7 comprises a second opening 52. The second opening 52 is arranged vertically aligned with the storage area 16 of the lower platform 8, when the upper and lower platforms 7, 8 are connected to the tower 9. This is to facilitate the moving of components from and to the storage area 16. For example, a component on the storage area 16 can be moved to the wind turbine 5 by using the crane 21 that picks a component on the storage area and lifts the component through the second opening 52 and moves the component to the wind turbine 5.

In this example, the upper platform 7 comprises one securing assembly 32. The securing assembly 32 comprises two arcuate arms 33 movable relative to each other in a plane perpendicular to the longitudinal axis of the tower. Accordingly, the two arcuate arms 33 are movable relative to each other in a horizontal plane. In one aspect, the arms 33 are pivotally attached to the upper platform 7 to allow the arms to be moved towards and away from each other. The arms are arranged rotatable about an axis in parallel with the longitudinal axis of the tower. The arcuate arms 33 are bent towards each other to allow them to clamp around the wind turbine and by that attach the upper platform 7 to the wind turbine. In one aspect, the arcuate arms are telescopic arms comprising a cover portion 34 and an extending portion 35. The extending portion 35 is adapted to at least partly be withdrawn into the cover portion 34 reducing the length of the arcuate arms 33. Suitably the extending portion comprises joints 37 allowing parts of it to curve and bend horizontally. In one example, the joints 37 are rotated by means of a wire extending through the arcuate arms 33 and connected to an outer end of the arcuate arms 33 and the upper platform 7. When the wire is then tensioned, the parts of the arcuate arms 33 comprising the joints 37 are curved inwards creating a better grip on the wind turbine 5.

In one aspect, the extending portion comprises three joints. The securing assembly 32 further comprises a rotating mechanism adapted to rotate the arcuate arms in the horizontal plane. In this example, the rotating mechanism is two hydraulic pistons 38 connected to each arcuate arm 33 and the upper platform 7. The hydraulic pistons are adapted to extend and retract, which causes the arcuate arms 33 to rotate in the horizontal plane. In this example, the securing assembly comprises a stability part 41 arranged on the upper platform 7. The stability part 41 is adapted to move linearly and by that increasing the stability of the tower by bearing against the wind turbine 5. The stability part 41 is adapted to bear against a portion of the wind turbine facing the first platform 7. The stability part prevents the tower 9 from tilting towards the wind turbine 5. By using the stability part along with the arcuate arms 33 on the wind turbine 5, the tower is locked from tilting in any direction relative the wind turbine 5.

In this example, the upper platform 7 comprises an upper platform drive unit 25. The upper platform drive unit 25 is adapted to move the upper platform 7 vertically. The upper platform 7 further comprises upper platform gear wheels 26 that are driven and turned by the upper platform drive unit 25. Suitably the upper platform gear wheels 26 are attached to opposite side of the first opening 17. The upper platform gear wheels 26 are adapted to engage with the gear racks 28 of the tower segment 13 as seen in FIG. 2. In this example, the number of upper platform gear wheels 26 is eight wherein one gear rack 28 receives two upper platform gear wheels 26. However, the number and arrangement of the upper platform gear wheels 26 can vary. The upper platform drive unit 25 is In this example, powered by a power supply unit 36 arranged on the upper platform 7. In other examples the upper platform drive unit can be powered with another power source e.g. a power supply unit on the ground or directly from a wind turbine. The power supply unit 36 can, for example, be an accumulator or a generator. Suitably the power supply unit also supplies the securing assembly with power.

Figure 4A:
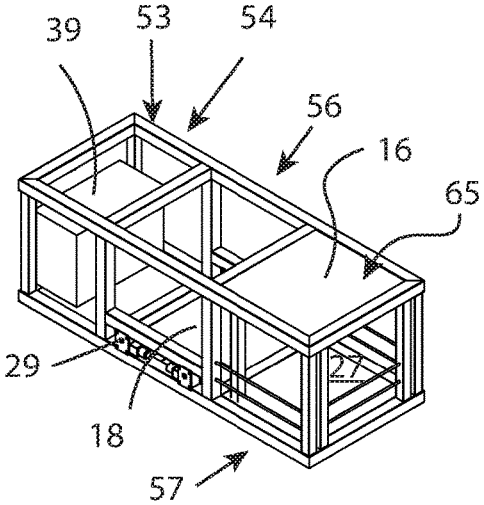
FIG. 4*a* shows an example of a lower platform including a storage area seen in a perspective view from above.

FIG. 4*a* shows an example of the lower platform 8. The storage area 16 is In this example, arranged on an upper part of the lower platform 8 and a space 27 for transportation of a passenger is defined below the storage area 16.

Figure 4B:
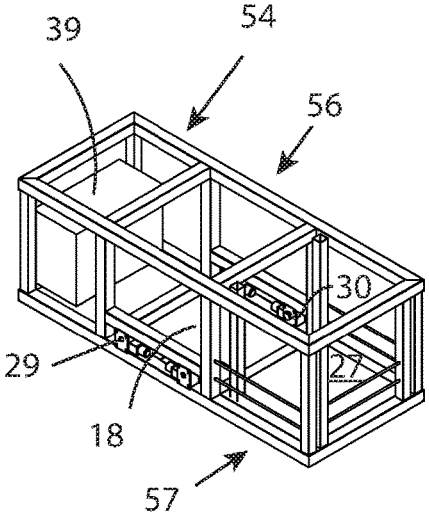
FIG. 4*b* shows the lower platform shown in FIG. 4*a* with the storage area removed.

FIG. 4*b* shows the same example of the lower platform 8 as FIG. 4*a*, but with the storage area 16 removed.

In this example, the lower platform 8 comprises a lower platform drive unit 29. The lower platform drive unit 29 is adapted to move the lower platform 8 in a direction parallel to the longitudinal axis of the tower, i.e. in a vertical direction. The lower platform further comprises lower platform gear wheels 30 that are driven and turned by the lower platform drive unit. Suitably the lower platform gear wheels 30 are attached to opposite side of the opening 18. The lower platform gear wheels 30 are adapted to engage with the gear racks 28 of the tower segment 13 as seen in FIG. 2. In this example, the number of lower platform gear wheels 30 is four, wherein one gear rack 28 receives one gear wheel 30. However, the number and arrangement of the gear wheels can vary. The lower platform drive unit 29 is on this example powered by a power supply unit 39 arranged on the lower platform 8. In another example the lower platform drive unit 29 is powered with another power source e.g. a power supply unit on the ground or directly from a wind turbine. The power supply unit 39 can, for example, be an accumulator or a generator. In one aspect of the invention the lower platform 8 is moved by means of the crane 21 on the upper platform 7, thus neither the drive unit 29 nor the gear wheels 30 are needed.

In this example, the lower platform 8 comprises a base frame 53 and a support member 65 having an upper surface defining the storage area 16. For example, the support member 65 is a square plate. However, other shapes are also possible. The support member is for example made out of steel or some kind of metal, but could also be made of any kind of high strength material such as carbon fibre. In one aspect, the support member 65 is arranged movable relative the base frame 53 in a vertical direction to allow the support area to be raised and lowered.

In this example, the base frame 53 comprises three sections. A first section 54 comprising in this example the power supply unit 39. A second section 56 arranged next to the first section comprising the opening 18, the lower platform drive unit 29 and the lower platform gear wheels 30. A third section 57 is arranged next to the second section 56. In one aspect the storage area 16 is arranged on the third section 57 as seen in FIG. 4*a*. In one aspect the third section 57 comprises the space 27 defining a passenger area. In this example, the sections are rectangular shaped.

In this example, the storage area is arranged on the third section 57 as seen in FIG. 4*a* and the support member (65) is arranged movable in a vertical direction relative the base frame (53). In this example, the power supply unit 39 and the storage area 16 are, therefore, on different sides on the lower platform 8 relative the opening 18 and the tower 9.

Figure 5:
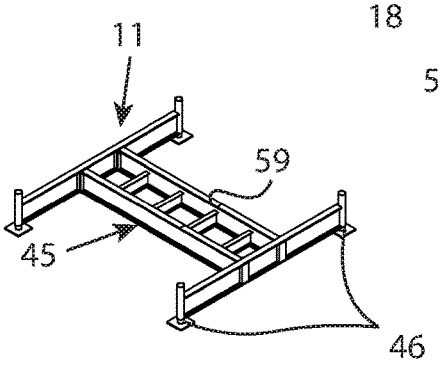
FIG. 5 shows an example of a support frame in a perspective view from above.

FIG. 5 shows an example of the support frame 11. In this example, the support frame 11 comprises a body 45, support legs 46 extending perpendicular to the body 45 and adapted to bear on the ground and support the body. The body comprises an attachment mechanism 61 for locking the tower 9 to the support frame 11.

The support frame 11 comprises a plurality of support legs 46. The support frame 11 further comprises a transfer unit 58 adapted to move the tower in a horizontal direction relative to the support frame 11. In one example the transfer unit comprises two support frame rails 59 and support frame sliding portions (not shown) adapted to slide horizontally on the support frame rails 59. The sliding portions are locked from moving out of the support frame rails 59. Each sliding portion comprises one attachment mechanism for attaching the sliding portion to the tower 9 resulting in that the tower 9 becomes locked to the support frame 11. The tower 9 is adapted to move on the support frame rails 59 so to increase and decrease the distance between the tower 9 and the wind turbine 5. In one example the transfer unit 58 comprises a driving unit (not shown) adapted to move the tower 9 on the support frame rails 59. The driving unit can be powered by a e.g. generator or an extern source.

Figure 6C:
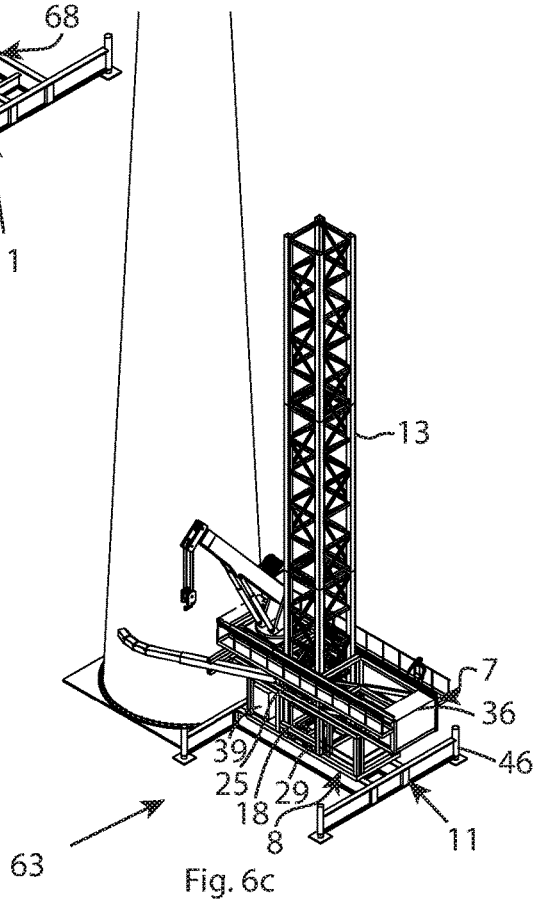

FIGS. 6*a-c* show an example of how a tower base 63 is assembled. FIG. 6*a* shows the support frame 11 in close proximity to a wind turbine 5. In one example a transportation vehicle transports the support frame 11 to the wind turbine 5 and positions it in close proximity to the wind turbine 5. The support legs 46 attached to the support frame 11 are lowered before placing the support frame 11 on the ground. Once the support frame 11 is positioned on the ground, the lower platform 8 is positioned above the support frame 11. The upper platform 7 is then positioned above the lower platform 8 in a way which allows the first opening 17 to be vertically aligned with the opening 18 on the lower platform 8. FIG. 6*b* shows the support frame 11 with the lower platform 8 and the upper platform 7 arranged on the support frame 11. A tower segment 13 is then attached to the support frame 11 and positioned in the first opening 17 on the upper platform 7 and the opening 18 on the lower platform 8. In this example, two more tower segments 13 are then attached forming the tower base 63. FIG. 6*c* shows the tower base 63 comprising three tower segments 13, the support frame 11 and the lower and upper platforms 8, 7. In one example the tower segments 13, and the lower and upper platforms 8, 7 are lifted onto the support frame 11 by means of a second crane attached to a truck. In this example, the power supply units 36, 39, e.g. diesel generators, are positioned on the upper and lower platforms when the lifting is started. In another example the support frame 11, the lower and upper platforms 8, 7 and one tower segment 13 are pre-assembled before the transportation vehicle is loaded.

Figure 7A:
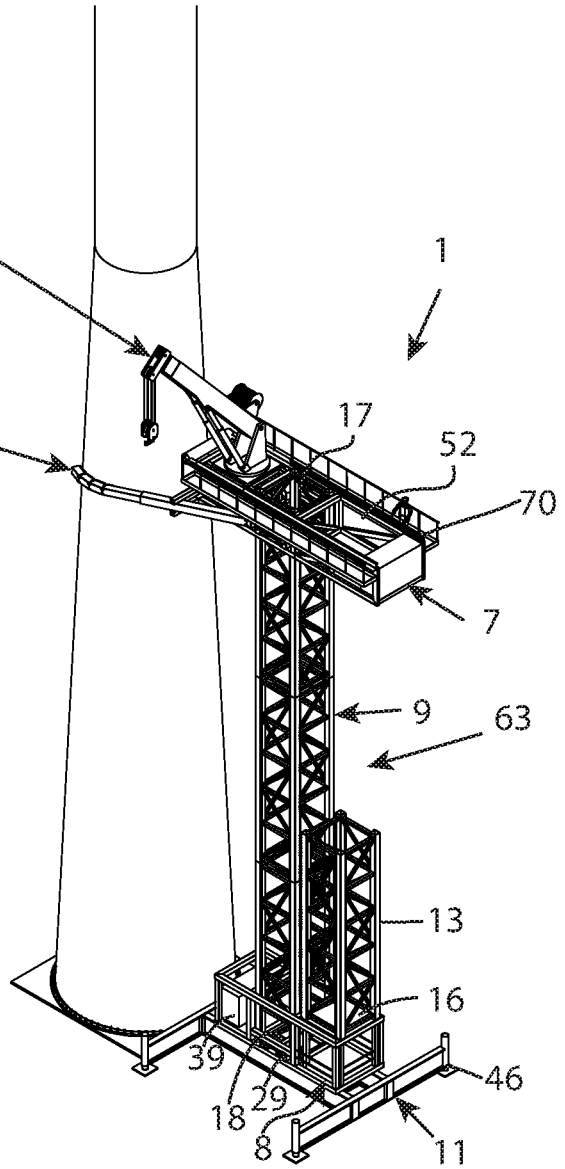
FIGS. 7*a-e* illustrate an example of a method for attaching a tower segment to the tower base.

FIGS. 7*a-e* show an example of the lifting assembly 1 attaching a tower segment 13 to the tower base 63. FIG. 7*a* shows the upper platform 7 in the upper position and the lower platform 8 in its lowest position and bearing against the support frame 11. The tower segment 13 has been arranged on the storage area 16. In one example the tower segment 13 is lifted onto the lower platform 8 by means of a second crane attached to a truck. The tower segment 13 can then be elevated by allowing the lower platform 8 to move upwards.

Figure 7B:
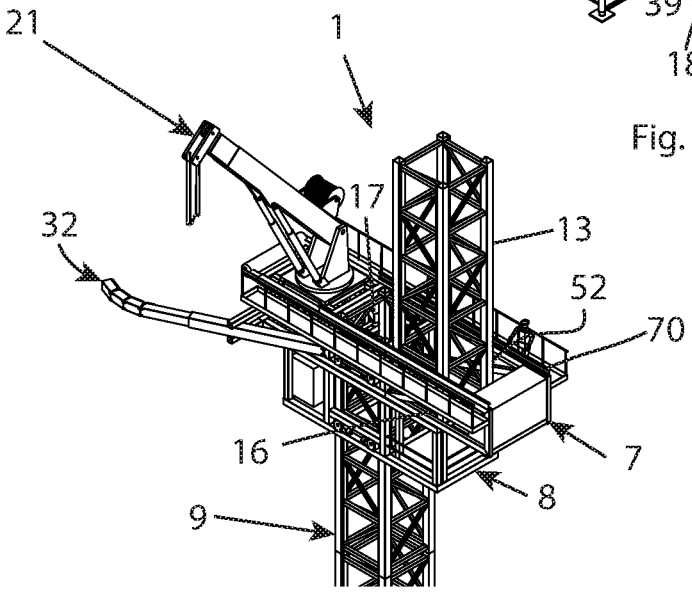

FIG. 7*b* shows the upper platform 7 in the upper position and the lower platform 8 has been moved to a position just below the upper platform 7. The tower segment 13 supported by the storage area 16 is partly extending through the second opening 52. In this example, the lower platform 8 comprises the support member 65 comprising the storage area 16. The lower platform 8 further comprises a lifting mechanism adapted to lift the support member 65 relative to the tower base 63 to the second opening 52. In another example the tower segment 13 can be lifted through the second opening 52 by the crane 21. The lifting mechanism and the support member 65 are also designed to lift other components e.g. a gear box or a generator to the wind turbine.

Figure 7C:
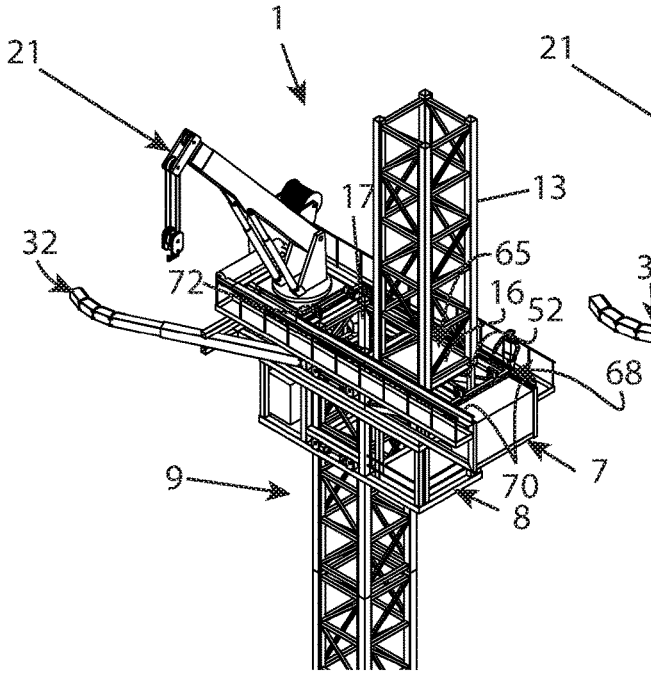

FIG. 7*c* shows the lifting assembly 1 with the tower segment 13 arranged on the support member 65 and the support member 65 has been lifted to the second opening 52. In this embodiment the upper platform 7 comprises a transportation unit 68 adapted to move the tower segment 13 from the second opening 52 to the first opening 17. In this example, the transportation unit 68 comprises two transportation unit rails 70 arranged on the upper platform 7. In this example, the rails 70 extend from the end of the upper platform 7 positioned furthest from the crane 21 to the end of the first opening 17 and the transportation unit rails 70 are arranged on different sides of the platform 7. The upper platform 7 further comprises a platform sliding portion 72 adapted to attach to the tower segments 13 and engage with the rails 70. In this example, two sliding portions 72 are used, and the sliding portions can be separated and attached to the tower segments 13. The two sliding portions 72 are adapted to attach to different sides of the tower segments 13 to better distribute the weight of the tower segments 13. In other examples the platform sliding portions 72 may be incorporated into each of the tower segments. The sliding portions 72 are moved on the transportation unit rails 70 by means of a driving unit (not shown). The driving unit can be powered by e.g. the power supply unit or an extern power source.

Figure 7D:
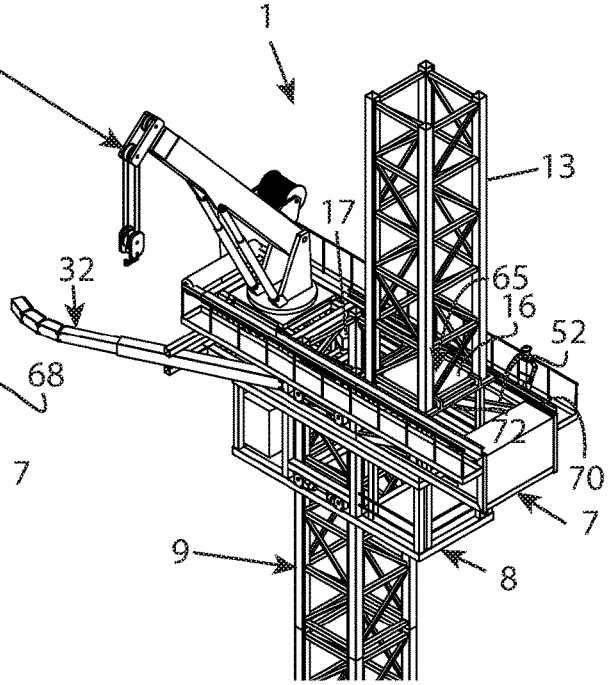

FIG. 7*d* shows the lifting assembly with the platform sliding portions 72 attached to the tower segment 13.

Figure 7E:
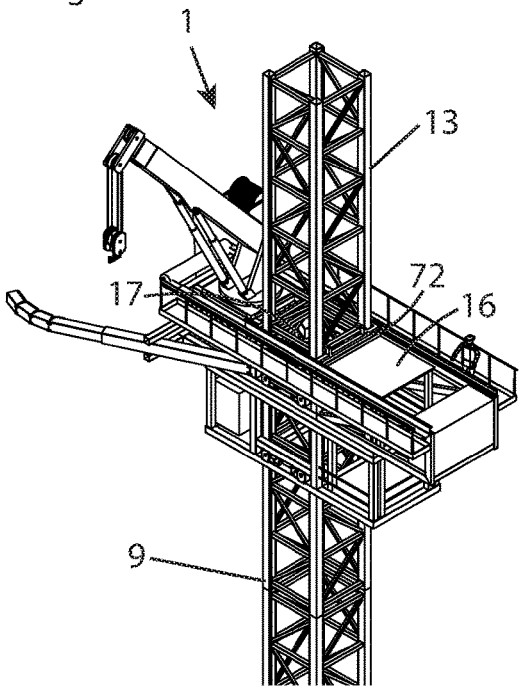

FIG. 7*e* shows the lifting assembly 1 with the tower segment 13 moved to the first opening 17 by means of the platform sliding portion 72. When the tower segment 13 is in this position the tower segment 13 can be attached to the tower 9. The method described in FIGS. 7*a-e* is preferable used for mounting all of the tower segments except those in the base structure.

FIGS. 8*a-d* show an example of a method for removing a component 3 from a nacelle in the wind turbine 5.

Figure 8A:
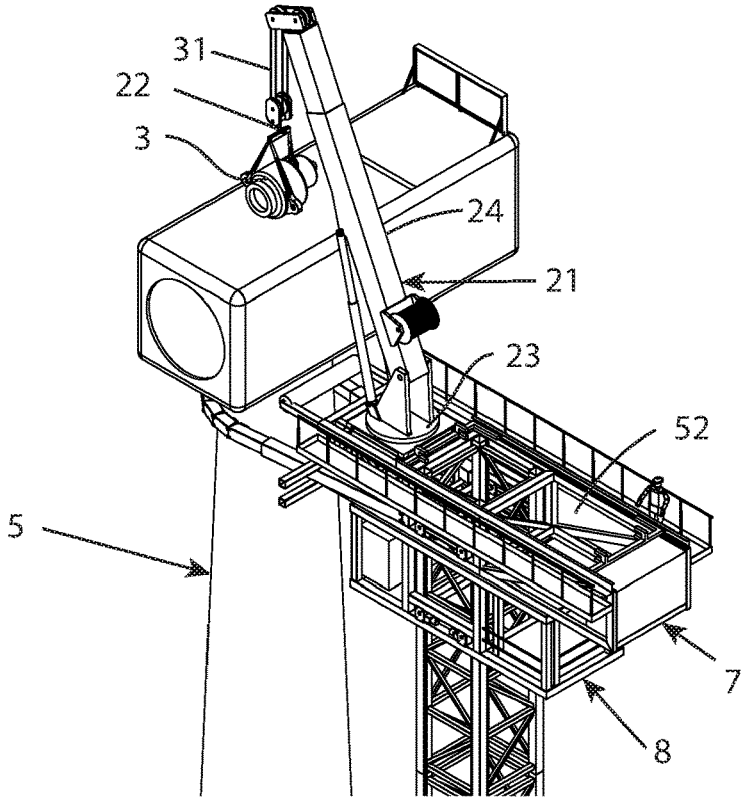
FIGS. 8*a-d* illustrate an example of a method of removing a component from a nacelle in a wind turbine.

FIG. 8*a* shows the upper platform 7 in the upper position and the lower platform 8 in the uppermost position under the upper platform. The upper platform 7 is fixedly attached to the wind turbine by means of the securing assembly. In this example, the crane 21 comprises a base part 23 connected to the upper platform 7 and a jib 24 rotatably connected to the base part 23. The jib 24 is adapted to lift and move the components 3 to and from the lower platform 8 by means of a hook 22 connected to the jib 24 by means of a wire 31. In FIG. 8*a* the crane 21 has removed the component 3 from the wind turbine 5 and the component 3 is seen elevated above the wind turbine 5 by means of the wire 31. The base part 23 is then rotated so the component 3 is positioned above the second opening 52.

Figure 8B:
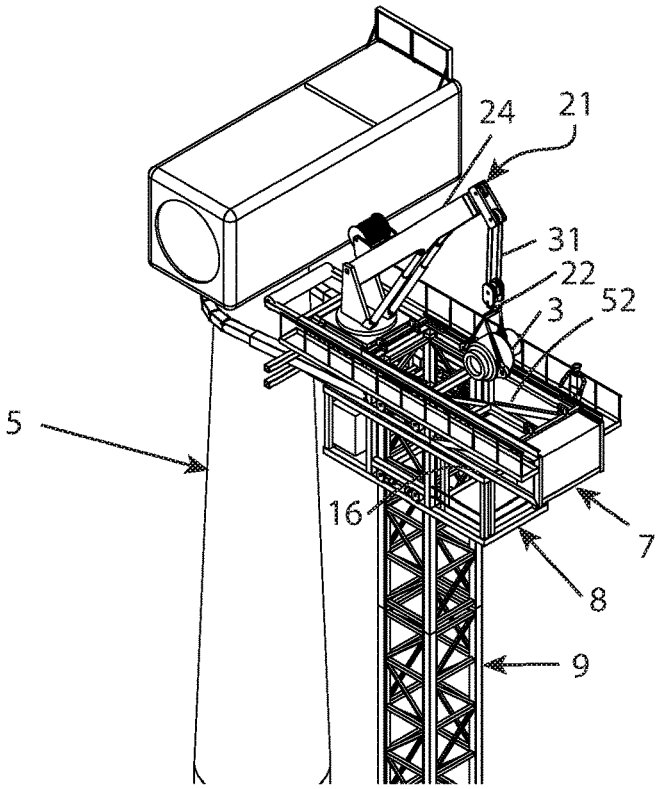

FIG. 8*b* shows the component 3 being positioned above the second opening 52 on the upper platform 7. In this example, the component 3 is then lowered through the second opening 52 to the storage area 16. The component 3 can then be further lowered by vertically moving the lower platform 8 towards the support frame 11 seen in FIG. 8*d*.

Figure 8C:
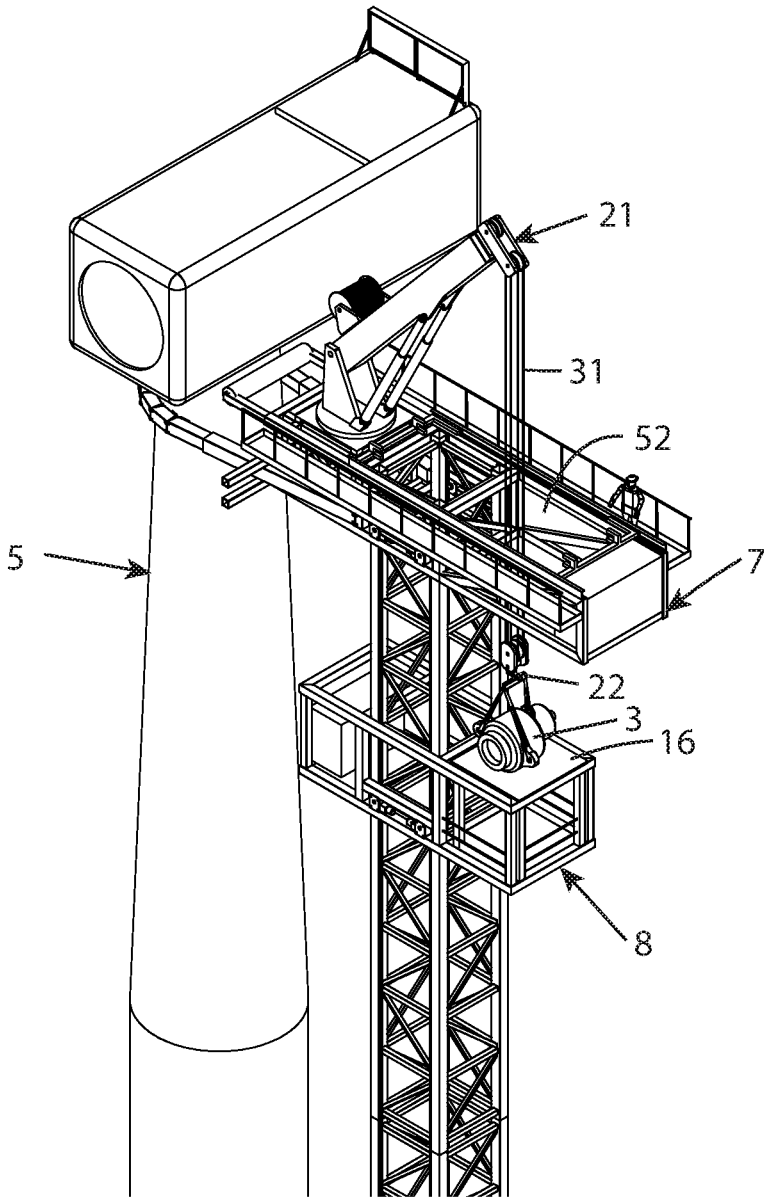

FIG. 8*c* shows the storage area 16 supporting the component 3. The lower platform 8 has been vertically moved at a distance from the upper platform 7 closer to the support frame 11. In this example, the wire 31 and the crane hook 22 are still connected to the component 3 in order to stabilize the component 3 and reduce the pressure the component 3 constitutes on the storage area 16.

Figure 8D:
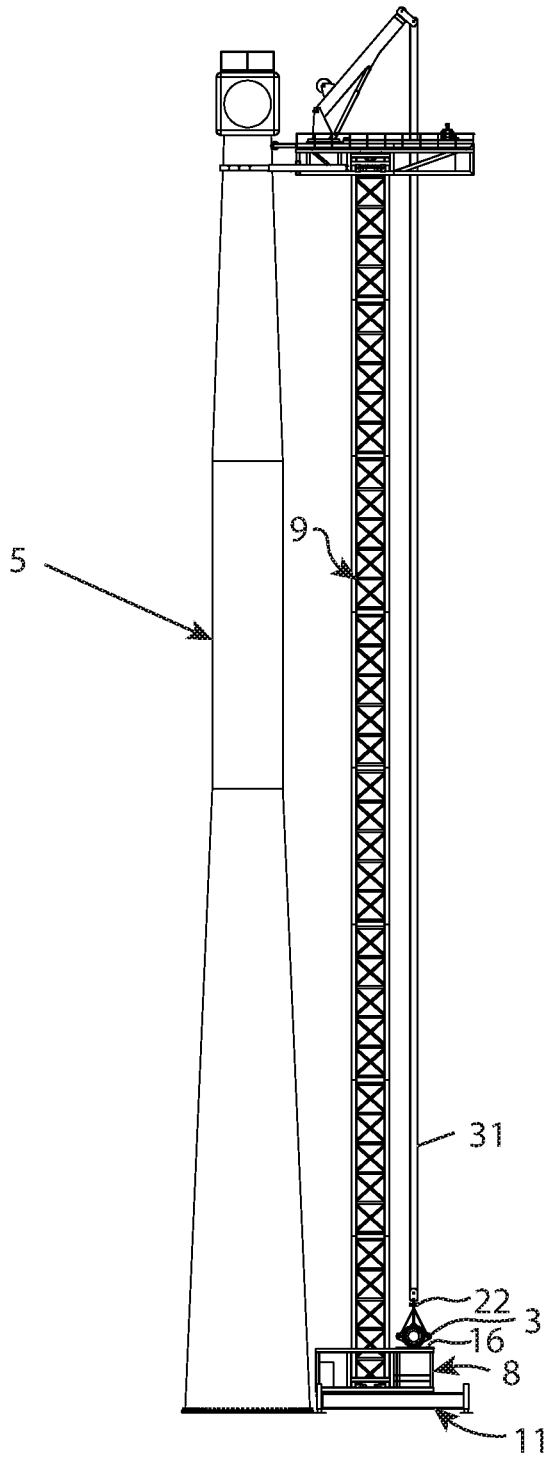

FIG. 8*d* shows the lifting assembly 1 with the lower platform 8 on the support frame 11 and with the component 3 on the storage area 16. The component 3 can now be removed from the lifting assembly 1 and moved to e.g. a truck. In one example this is done by means of a second crane positioned on the ground or on a truck.

The method of moving a new component to the nacelle in the wind turbine 5 can be done in the same way as removing an old component but in reversed order.

The present invention is not limited to the embodiments disclosed but may be varied and modified within the scope of the following claims.

The invention claimed is:

1. A lifting assembly (1) for elevating components (3) to a wind turbine (5) comprising:

a plurality of tower segments (13) which together form an elongated tower (9), a support frame (11) for supporting the tower (9), a securing assembly (32) securing the tower (9) to the wind turbine (5), and a crane (21), wherein the lifting assembly (1) comprises:

an upper platform (7) vertically movable along the tower (9), and a lower platform (8) vertically movable along the tower (9) between the upper platform (7) and the support frame (11), wherein the crane (21) is disposed on the upper platform (7) and the lower platform (8) is provided with a storage area (16) for supporting the components (3), and the crane (21) is adapted to move the components (3) to and from said storage area (16) of the lower platform (8).

2. The lifting assembly (1) according to claim 1, wherein each of the upper and lower platforms (7, 8) is provided with an opening (17, 18) for receiving the tower (9), and the openings (17, 18) are aligned in a vertical direction.

3. The lifting assembly (1) according to claim 1, wherein the upper platform (7) comprises a second opening (52) aligned with the storage area (16) to allow the components (3) to be moved from the storage area (16) through the second opening (52) to the upper platform (7).

4. The lifting assembly (1) according to claim 1, wherein the lower platform (8) comprises a base frame (53) and a support member (65) having an upper surface defining said storage area (16), and the support member (65) is arranged to be movable in a vertical direction relative to the base frame (53).

5. The lifting assembly (1) according to claim 4, wherein the upper platform (7) comprises a transportation unit (68) adapted to move a tower segment (13) between the second opening (52) and the first opening (17).

6. The lifting assembly (1) according to claim 1, wherein the upper platform (7) comprises an upper platform drive unit (25) for the vertical movement of the upper platform (7) and an upper platform power supply unit (36) adapted to provide the upper platform drive unit (25) with power, and the lower platform (8) comprises a lower platform drive unit (29) for the vertical movement of the lower platform (8) and a lower platform power supply unit (39) adapted to provide the lower platform drive unit (29) with power.

7. The lifting assembly (1) according to claim 6, wherein the tower segments (13) comprise gear racks (28), the upper platform (7) comprises at least one upper platform gear wheel (26) turned by the upper platform drive unit (25) and adapted to engage with the gear racks (28) on the tower segments (13), and the lower platform (8) comprises at least one lower platform gear wheel (30) turned by the lower platform drive unit (29) and adapted to engage with the gear racks (28) on the tower segments (13).

8. The lifting assembly (1) according to claim 6, wherein each of the upper and lower platforms (7, 8) is provided with an opening (17, 18) for receiving the tower (9), and the openings (17, 18) are aligned in a vertical direction, and the lower platform power supply unit (39) and the storage area (16) are arranged on opposite sides of the first opening (18) of the lower platform (8).

9. The lifting assembly (1) according to claim 8, wherein the tower segments (13) comprise gear racks (28), the upper platform (7) comprises at least one upper platform gear wheel (26) turned by the upper platform drive unit (25) and adapted to engage with the gear racks (28) on the tower segments (13), and the lower platform (8) comprises at least one lower platform gear wheel (30) turned by the lower platform drive unit (29) and adapted to engage with the gear racks (28) on the tower segments (13).

10. The lifting assembly (1) according to claim 1, wherein the securing assembly (32) is attached to the upper platform (7).

11. The lifting assembly according to claim 1, wherein the securing assembly (32) comprises two arms (33) movable relative to each other and the arms (33) are bent towards each other to allow them to clamp around the wind turbine (5).

12. The lifting assembly (1) according to claim 11, wherein said arms (33) are pivotally attached to the upper platform (7).

13. The lifting assembly (1) according to claim 1, wherein the storage area (16) is arranged on an upper part of the lower platform (8) and a space (27) for transportation of a passenger is defined below the storage area (16).

14. The lifting assembly (1) according to claim 1, wherein the support frame (11) comprises a transfer unit (58) adapted to move the tower (9) in a horizontal direction relative to the support frame (11).

15. The lifting assembly (1) according to claim 1, wherein the storage area (16) is designed for supporting the components (3) weighing more than 10 tons.

16. The lifting assembly (1) according to claim 15, wherein the storage area (16) is designed for supporting the components (3) weighing more than 20 tons.

17. The lifting assembly (1) according to claim 16, wherein the storage area (16) is designed for supporting the components (3) weighing more than 30 tons.

* * * * *